US009677762B2

(12) United States Patent
Tullos

(10) Patent No.: US 9,677,762 B2
(45) Date of Patent: Jun. 13, 2017

(54) AUTOMATED FLARE CONTROL

(75) Inventor: Erin E. Tullos, Bartlesville, OK (US)

(73) Assignee: Phillips 66 Company, Houston, TX (US)

( * ) Notice: Subject to any disclaimer, the term of this patent is extended or adjusted under 35 U.S.C. 154(b) by 579 days.

(21) Appl. No.: 13/022,961

(22) Filed: Feb. 8, 2011

(65) Prior Publication Data

US 2011/0195364 A1 Aug. 11, 2011

Related U.S. Application Data

(60) Provisional application No. 61/302,853, filed on Feb. 9, 2010.

(51) Int. Cl.
*F23L 7/00* (2006.01)
*F23G 7/08* (2006.01)
*F23G 5/50* (2006.01)

(52) U.S. Cl.
CPC ..... *F23G 7/085* (2013.01); *F23G 5/50* (2013.01)

(58) Field of Classification Search
USPC ..... 431/2, 202; 340/578
See application file for complete search history.

(56) References Cited

U.S. PATENT DOCUMENTS 3,322,178 A 5/1967 Nahas
3,667,408 A * 6/1972 Jasinsky ..... F23G 7/08 110/119
3,782,880 A 1/1974 Eubanks
3,893,810 A * 7/1975 Lientz ..... F23G 7/085 422/111
3,965,748 A * 6/1976 Boubel ..... G01N 1/2247 73/28.01
4,094,632 A * 6/1978 Reed ..... F23G 7/085 422/182
4,174,943 A * 11/1979 Reed ..... F23N 1/02 431/41
4,233,596 A * 11/1980 Okamoto ..... F23N 5/082 250/339.15
4,342,550 A * 8/1982 Tuck ..... F23L 7/005 431/202
RE31,215 E 4/1983 Stranahan et al.
(Continued)

FOREIGN PATENT DOCUMENTS

CA 983383 2/1976

OTHER PUBLICATIONS

Environmental Biotechnology: Basic Concepts and Applications, by Indu Shekhar Thakur, Publsihed Jan. 1, 2006 http://books.google.com/books?id=5sBU2aE9xfUC&pg=PA456&dq=particulate+matter+control+steam+injection+thakur&hl=en&sa=X&ei=3hG2Ud3rGcG90gGh2IGQBA&ved=0CD4Q6AEwAQ#v=onepage&q=particulate%20matter%20control%20steam%20injection%20thakur&f=false.*

*Primary Examiner* — Avinash Savani
*Assistant Examiner* — George R Blum
(74) *Attorney, Agent, or Firm* — Phillips 66 Company

(57) ABSTRACT

Methods and apparatus relate to control of smoke suppressant flow rate to a flare that disposes of combustible gas, such as waste from refineries and chemical plants. One or more detectors produce signals that enable separate monitoring of both particulate emissions from the flare and combustion efficiency of the flare. Adjusting the flow rate of the smoke suppressant to the flare in response to such dual monitoring facilitates operation of the flare so as to manage environmental pollution caused by unburned volatile organic compounds and smoke emitted from the flare.

5 Claims, 2 Drawing Sheets

(56) References Cited

U.S. PATENT DOCUMENTS 4,492,558 A * 1/1985 Schwartz ..... F23G 7/085 431/202
4,505,668 A * 3/1985 DiBiano ..... F23G 7/085 431/202
4,620,491 A 11/1986 Nishikawa et al.
5,533,890 A * 7/1996 Holst ..... F23C 99/006 422/177
5,632,614 A * 5/1997 Consadori ..... F23N 5/082 219/260
5,986,553 A * 11/1999 Young ..... G01F 1/74 340/606
7,316,562 B2 * 1/2008 Trefall ..... F23G 7/08 102/202.5
7,876,229 B2 * 1/2011 Rao ..... G06K 9/4652 250/554
8,138,927 B2 * 3/2012 Diepenbroek ..... F23G 5/50 250/554
9,267,686 B1 * 2/2016 Little ..... F23N 5/242
2006/0257299 A1 * 11/2006 Lanz ..... B01D 53/32 422/186.04
2008/0233523 A1 * 9/2008 Diepenbroek ..... F23G 5/50 431/14
2008/0249697 A1 * 10/2008 Stewart ..... F02D 31/007 701/106
2009/0056416 A1 * 3/2009 Nair ..... G01N 15/0656 73/28.01
2009/0256714 A1 * 10/2009 Loepfe ..... G08B 29/22 340/628
2009/0301180 A1 * 12/2009 Reutiman ..... G01N 15/0656 73/114.71
2009/0309028 A1 * 12/2009 Venkoparao ..... G01J 5/0014 250/338.5
2011/0080296 A1 * 4/2011 Lance ..... G08B 17/06 340/578
2011/0085030 A1 * 4/2011 Poe ..... F23G 5/50 348/61
2012/0001760 A1 * 1/2012 Harchanko ..... G08B 17/12 340/578
2012/0126985 A1 * 5/2012 Au ..... A61B 5/1117 340/578
2015/0104752 A1 * 4/2015 Lang ..... F23D 14/04 431/202
2015/0219333 A1 * 8/2015 Colannino ..... F23C 99/001 431/2
2015/0323177 A1 * 11/2015 Kovash ..... F23G 7/08 431/202

* cited by examiner

AUTOMATED FLARE CONTROL

CROSS-REFERENCE TO RELATED APPLICATIONS

This application is a non-provisional application which claims the benefit of and priority to U.S. Provisional Application Ser. No. 61/302,853 filed Feb. 9, 2010, entitled "Automated Flare Control," which is hereby incorporated by reference in its entirety.

STATEMENT REGARDING FEDERALLY SPONSORED RESEARCH OR DEVELOPMENT

None

FIELD OF THE INVENTION

Embodiments of the invention relate to methods and systems for monitoring and controlling a flare.

BACKGROUND OF THE INVENTION

Refineries and chemical plants often discharge combustible waste gas to a flare. The flare can produce undesirable emissions in form of particulate smoke and smokeless release of the waste gas that remains unburned from inefficient combustion. Both types of the emissions present environmental pollution issues.

The combustion efficiency of the flare fails to provide a direct correlation to whether or not the flare produces smoke. Even with almost complete combustion, the flare may produce unacceptable levels of the smoke. The flare may however not generate any smoke while operating at unacceptable low levels for the combustion efficiency.

Injecting steam at combustion of the waste gas facilitates with suppressing generation of the smoke. Prior systems utilize various techniques that attempt to determine amount of the steam needed to ensure suppression of the smoke. Given lack of correlation between the combustion efficiency and smoking, problems can arise with these techniques resulting in the flare still emitting either the smoke or smokeless release of the waste gas that remains unburned. The flare for example may produce the smoke despite a false smokeless determination based only on the combustion efficiency as may be determined by infrared radiation measurements. In addition, introducing more of the steam to the flare may further reduce the combustion efficiency when assuming that the combustion efficiency being below a certain point implies tendency for the flare to produce the smoke.

Therefore, a need exists for improved methods and systems for monitoring and controlling a flare.

SUMMARY OF THE INVENTION

In one embodiment, a system for monitoring and controlling a flare includes a particulate matter sensor disposed to sense smoke from the flare and a combustion efficiency sensor disposed to sense a parameter of the flare indicative of emission level of unburned volatile organic compounds from the flare. The smoke is detectable by the particulate matter sensor independent from combustion efficiency of the flare. Further, a controller of the system adjusts rate of smoke suppressant injection to the flare based on signals received from the particulate matter sensor and the combustion efficiency sensor.

According to one embodiment, a method of monitoring and controlling a flare includes detecting particulate matter emitted from a flare and detecting a parameter of the flare indicative of combustion efficiency of the flare. The detecting of the particulate matter is independent from combustion efficiency of the flare. The method further includes adjusting rate of smoke suppressant injection to the flare based on signals output from the detecting of the particulate mater and the parameter that is indicative of the combustion efficiency in order to limit smoke and emission level of unburned volatile organic compounds from the flare.

For one embodiment, a method of monitoring and controlling a flare includes detecting an attribute influenced by particulate matter emitted from the flare such that a first signal is produced. Measuring at least one of temperature of the flare and volatile organic compounds emitted beyond a flame of the flare produces a second signal. In addition, the method includes increasing rate of steam injection to the flare in order to limit smoke level upon the first signal reaching a first threshold and decreasing the rate of steam injection to the flare in order limit combustion inefficiency upon the second signal reaching a second threshold.

BRIEF DESCRIPTION OF THE DRAWINGS

The invention, together with further advantages thereof, may best be understood by reference to the following description taken in conjunction with the accompanying drawings.

DETAILED DESCRIPTION OF THE INVENTION

Embodiments of the invention relate to control of smoke suppressant flow rate to a flare that disposes of combustible gas, such as waste from refineries and chemical plants. One or more detectors produce signals that enable separate monitoring of both particulate emissions from the flare and combustion efficiency of the flare. Adjusting the flow rate of the smoke suppressant to the flare in response to such dual monitoring facilitates operation of the flare so as to manage environmental pollution caused by unburned volatile organic compounds and smoke emitted from the flare.

Figure 1:
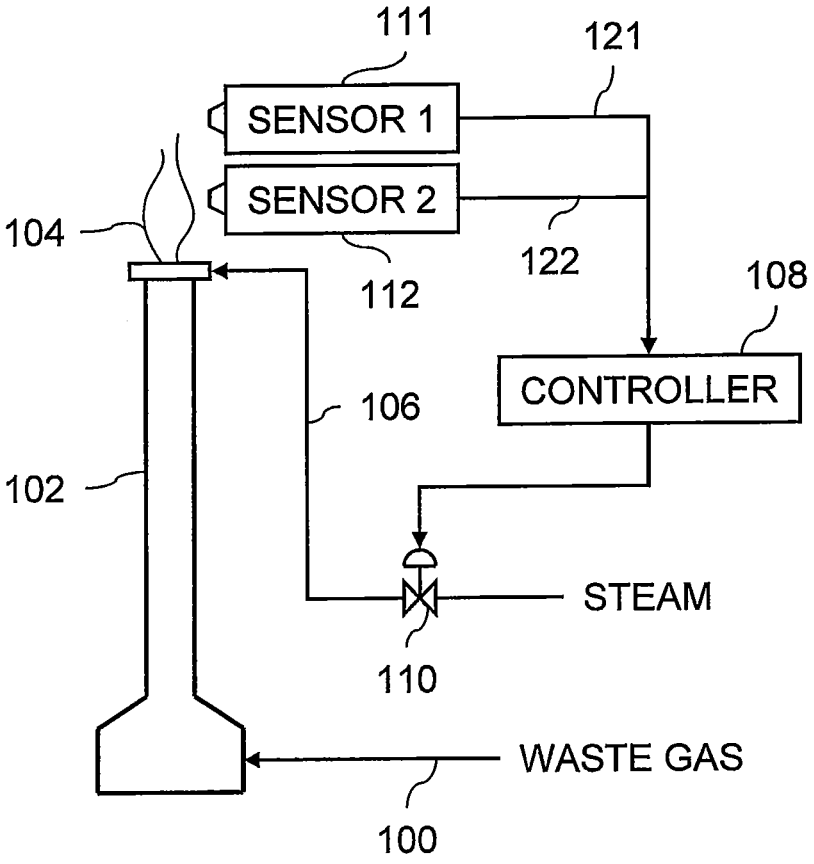
FIG. 1 is a schematic of a system for monitoring and controlling a flare, according to one embodiment.

FIG. 1 illustrates a system that includes a stream of waste gas 100 supplied to a flare 102. The waste gas 100 may contain combustible hydrocarbons that come from a refinery or plant and are burned at a flame 104 exiting the flare 102. A smoke suppressant line 106 supplies steam and/or air to the flare 102 for injection into the flame 104.

The system further includes a controller 108 that operates a valve 110 along the smoke suppressant line 106 to adjust flow rate of the steam introduced to the flare 102. First and second sensors 111, 112 couple with the controller 108 and output first and second signals 121, 122 to the controller 108. As discussed herein, the controller 108 functions the valve 110 in response to both the first and second signals 121, 122.

The first sensor 111 detects smoke from the flare 102 and hence may be referred to as a particulate matter sensor. The first sensor 111 detects the smoke from the flare 102 independent from combustion efficiency of the flare 102. Sensing an attribute influenced by particulate matter utilizing the first sensor 111 provides ability to detect the smoke without relying on assumptions from indirect sensing techniques not based on actual particulate matter being produced.

The second sensor 112 detects a parameter of the flare 102 indicative of emission level of unburned volatile organic compounds from the flare 102 and hence may be referred to as a combustion efficiency sensor. For example, the second sensor 112 detects at least one of temperature of the flame 104 and volatile organic compound levels emitted beyond the flame 104. While the volatile organic compound levels provide direct measurement of combustion efficiency, measuring the temperature in or near the flame 104 also provides an indication of combustion efficiency since dropping temperature corresponds to decreasing of the combustion efficiency or incomplete combustion where more of the volatile organic compounds are emitted from the flare 102 unburned.

The first sensor 111 based on location and orientation interrogates for the smoke above or downwind from the flame 104. The second sensor 112 depending on analytical approach may sense the parameter in, near, above or downwind of the flame 104 and is disposed and arranged accordingly. While shown on top of the flare 102, either or both of the first and second sensors 111, 112 may be located at remote positions, such as when detection relies on spectroscopic analysis techniques described herein. For some embodiments, the first and second sensors 111, 112 even though depicted separate may rely on a single common detector (e.g., an infrared (IR) camera discussed further herein) from which separate distinct measurements are capable of deriving the first signal 121 and the second signal 122.

The controller 108 includes logic stored on computer readable memory and configured to perform operations as described herein with respect to functioning of the valve 110 in response to the first and second signals 121, 122 from the first and second sensors 111, 112. In some embodiments, the controller 108 automates adjusting the flow rate of the steam to the flare 102 without depending on operator intervention. The controller 108 by utilizing both the first and second signals 121, 122 ensures efficient management of pollutants from not only the smoke emitted from the flare but also the unburned volatile organic compounds.

Figure 2:
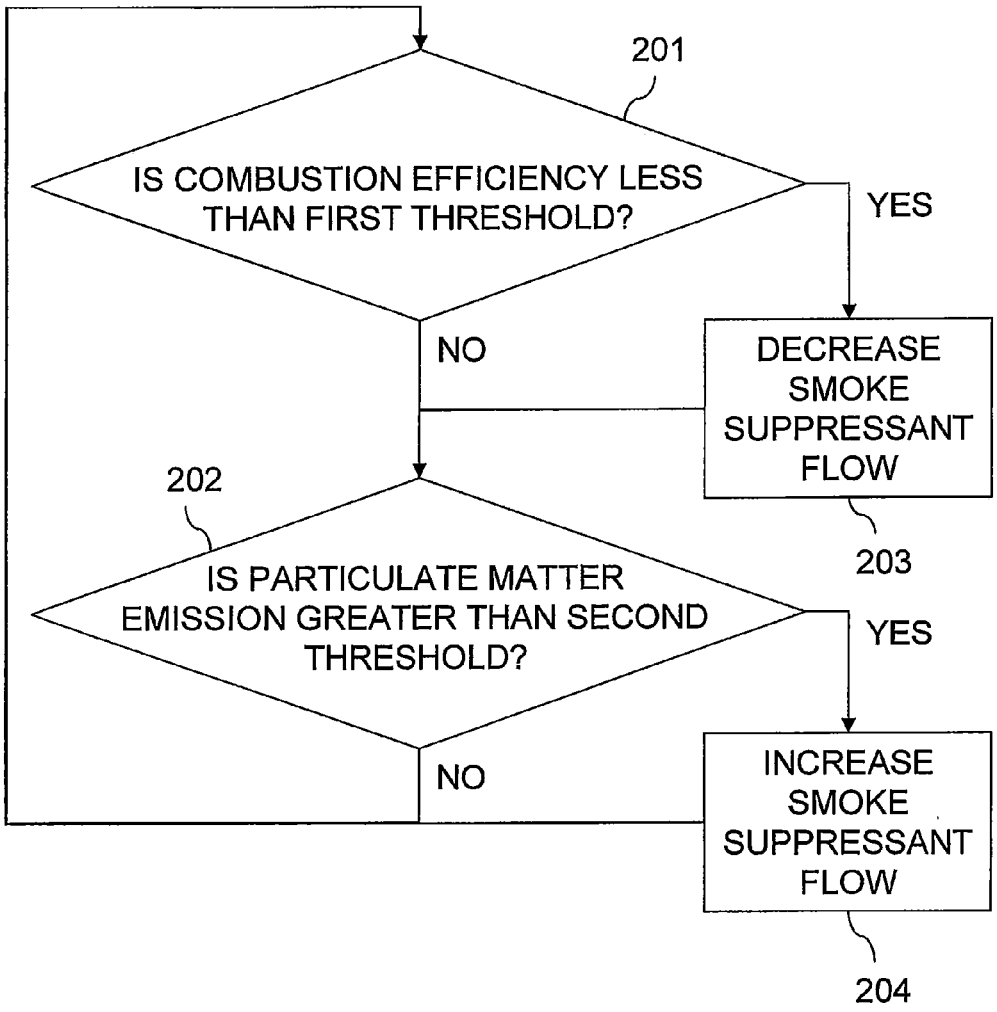
FIG. 2 is a flow chart illustrating a method of monitoring and controlling a flare, according to one embodiment.

FIG. 2 shows an exemplary processing method that may be performed by the controller 108 in response to the first and second signals 121, 122 provided by monitoring of the flare 102. In a first inquiry step 201, the controller 108 determines if the second signal 122 corresponds to the combustion efficiency being below a first threshold. If the combustion efficiency is determined to be below the first threshold, the controller 108 in an inefficiency decision step 203 operates the valve 110 to decrease the flow rate of the steam. Thereafter or if the combustion efficiency is above the first threshold, the controller 108 determines if the first signal 121 corresponds to particulate matter emission being greater than a second threshold, in second inquiry step 202. If the particulate matter emission is determined to be above the second threshold, the controller 108 pursuant to a smoking decision step 204 operates the valve 110 to increase the flow rate of the steam. The controller 108 may iterate as shown through the first and second inquiry steps 201, 202 and/or alter the first and second thresholds until pollution produced by the flare 102 is achieved and maintained at a level as low as possible.

Exemplary types of the first sensor 111 capable of detecting the particulate matter include optical, electrical or ionization based devices. In some embodiments, the first sensor 111 detects amount of light or infrared radiation to determine presence of the smoke based on changes in transmittance or backscattering caused by the smoke. Attenuation from transmission loss by the smoke within an optical path of the first sensor 111 or backscatter by the smoke of radiation toward the first sensor 111 that would otherwise bypass the first sensor 111 hence produces the first signal 121 from the first sensor 111. A source, daylight or the flame 104 may provide the light or infrared radiation being analyzed for either detection of the particulate matter or the combustion efficiency. For consistency and to avoid environmental factors such as weather and time of day, the source may pass electromagnetic energy across an enclosed optical chamber through which at least a sampling of emissions including any smoke from the flame 104 are passed and thereby influence the transmittance or the backscattering of the electromagnetic energy detected inside the optical chamber with the first sensor 111.

The smoke may influence attributes other than the transmittance or the backscattering of electromagnetic energy when the first sensor 111 employs electrical or ionization detection approaches. For example, the first sensor 111 may include a probe for detection of electrical induced currents caused by particles flowing by the probe. The induced currents detected provide the first signal 121 as a function of the smoke present. Further, the smoke may interrupt, due to absorption of radiation by the smoke, a known current across a pair of electrodes between which the radiation passes. Detecting such interruption in the current provides the first signal 121 from the first sensor 111.

Examples of the second sensor 112 depend on the parameter that is sensed to provide the indication of the combustion efficiency. For example, a thermocouple located on top of the flare 102 may measure temperature of the flame 104. Analytical devices, such as gas chromatographs (GC) and/or flame ionization detectors (FID), capable of measuring volatile organic compounds may form the second sensor 112. However, cost and practicality of implementation on top of the flare or of providing sampling conduits between where emissions from the flame 104 are collected and the analytical device may determine suitability.

In some embodiments, the second sensor 112 includes, for example, an IR camera and detects infrared radiation from the flame 104 or associated with the emissions from the flame 104. For example, the second sensor 112 may detect infrared radiation generated from the flame 104 being absorbed by the emissions from the flame 104. In particular, absorption within the emissions from the flame 104 at selected wavelengths, such as about 3300 to about 3500 nanometers corresponding to C—H stretching in hydrocarbons, increases as the combustion efficiency decreases. The detection may include comparing amount of the infrared radiation detected within the emission from the flame 104 versus a region surrounding the emissions. The second sensor 112 calibrates absorption measurements taken across an optical path from a source and at the selected wavelengths in some embodiments to account for losses due to the smoke.

For some embodiments, the IR camera utilized for the second sensor 112 enables determination of the temperature of the flame 104, which indicates the combustion efficiency. Further, the IR camera employed as the second sensor 112 may detect emissive radiation (e.g., at 4400 nanometers) from carbon monoxide and/or carbon dioxide output from the flame 104 for use in known measurements for the combustion efficiency. The radiation detected from the carbon monoxide and/or the carbon dioxide may enable respective concentration determinations usable to evaluate the combustion efficiency or may be applied in a ratio with a background measurement at another emission wavelength to provide the second signal 122 indicative of the combustion efficiency.

In one exemplary embodiment based on the foregoing, the first sensor 111 and the second sensor 112 include an IR detector spaced from an origin of broadband IR emitting electromagnetic radiation. Separation between the origin of the broadband IR and an area sensed with the detector defines an interrogation zone including a flow path of the emissions from the flame 104 of the flare 102. To provide the first signal 121, the first sensor 111 detects overall backscatter of the electromagnetic radiation or at any wavelengths outside of absorption peaks for the volatile organic compounds. The second sensor 112 measures selective absorption of the electromagnetic radiation at one or more wavelengths (e.g., about 3500 nanometers) absorbed by the volatile organic compounds and thereby generates the second signal 122.

The preferred embodiment of the present invention has been disclosed and illustrated. However, the invention is intended to be as broad as defined in the claims below. Those skilled in the art may be able to study the preferred embodiments and identify other ways to practice the invention that are not exactly as described herein. It is the intent of the inventors that variations and equivalents of the invention are within the scope of the claims below and the description, abstract and drawings are not to be used to limit the scope of the invention.

The invention claimed is:

1. A system, comprising:

a flare having a flame for burning waste gases;

a smoke detecting electromagnetic energy sensor device comprising an enclosed optical chamber, a source arranged to pass electromagnetic energy across said optical chamber, and a sensing unit, wherein the source may pass electromagnetic energy across the enclosed optical chamber through which the sensor unit gathers at least a sampling of emissions including any smoke from the flame of the flare sensing a change in at least one of transmittance and backscattering of electromagnetic energy due to presence of smoke by sensing particulate matter coming from the flame of the flare, wherein the smoke is detectable by the electromagnetic energy sensor independent from combustion efficiency of the flare wherein the sensor unit detects the smoke inside the optical chamber and wherein the said electromagnetic energy sensor device creates a signal indicative of the smoke sensed in the optical chamber;

an infrared energy absorption sensor positioned to sense energy absorbed by volatile organic compounds in an interrogation zone outside of a flame zone of the flare wherein energy absorption by volatile organic compounds which indicate the level of unburned volatile organic compounds which therefore also provides an indication of the combustion efficiency of the flare wherein the said infrared energy absorption sensor creates a signal indicative of the volatile organic compounds sensed;

a smoke suppressant injector for injecting smoke suppressant into the flare; and a controller configured to adjust rate of smoke suppressant injection from the smoke suppressant injector to the flare based on signals received from either of the electromagnetic energy sensor device and the infrared energy absorption sensor, but receives signals from both, wherein the controller is programmed to deliver a rate of smoke suppressant high enough to prevent smoke from emanating from the flare and also maintain the rate of smoke suppressant sufficiently low enough to for the flame of the flare to burn a very high amount of any volatile organic compounds that might be delivered to the flare, especially when the infrared energy absorption sensor detects an undesirably high level of unburned volatile organic compounds emanating from the flare.

2. A system comprising:

a flare having a flame for burning waste gases;

a smoke detecting electromagnetic energy sensor device comprising an enclosed optical chamber, a source arranged to pass electromagnetic energy across said optical chamber, and a sensing unit, wherein the source may pass electromagnetic energy across the enclosed optical chamber through which the sensor unit gathers at least a sampling of emissions including any smoke from the flame of the flare sensing a change in at least one of transmittance and backscattering of electromagnetic energy due to presence of smoke by sensing particulate matter coming from the flame of the flare, wherein the smoke is detectable by the electromagnetic energy sensor independent from combustion efficiency of the flare wherein the sensor unit detects the smoke inside the optical chamber and wherein the said electromagnetic energy sensor device creates a signal indicative of the smoke sensed in the optical chamber;

a temperature sensor positioned to sense the temperature of the flare to provide an indication of the combustion efficiency of the flare;

a smoke suppressant injector for injecting smoke suppressant into the flare; and a controller configured to adjust rate of smoke suppressant injection from the smoke suppressant injector to the flare based on signals received from either of the electromagnetic energy sensor and the temperature sensor, but receive signals from both.

3. A system comprising:

a flare having a flame for burning waste gases;

a smoke detecting electromagnetic energy sensor device comprising an enclosed optical chamber, a source arranged to pass electromagnetic energy across said optical chamber, and a sensing unit, wherein the source may pass electromagnetic energy across the enclosed optical chamber through which the sensor unit gathers at least a sampling of emissions including any smoke from the flame of the flare sensing a change in at least one of transmittance and backscattering of electromagnetic energy due to presence of smoke by sensing particulate matter coming from the flame of the flare, wherein the smoke is detectable by the electromagnetic energy sensor independent from combustion efficiency of the flare wherein the sensor unit detects the smoke inside the optical chamber and wherein the said electromagnetic energy sensor device creates a signal indicative of the smoke sensed in the optical chamber;

a combustion efficiency electromagnetic energy sensor positioned to sense a change in at least one of absorbance and emission of electromagnetic energy due to constituents from the flare which is an indication of the combustion efficiency of the flare;

a smoke suppressant injector for injecting smoke suppressant into the flare; and a controller configured to adjust rate of smoke suppressant injection from the smoke suppressant injector to the flare based on signals received from either of the smoke detecting electromagnetic energy sensor and the combustion efficiency electromagnetic energy sensor, but receive signals from both.

4. A system comprising:

a flare having a flame for burning waste gases;

a smoke detecting electromagnetic energy sensor device comprising an enclosed optical chamber, a source arranged to pass electromagnetic energy across said optical chamber, and a sensing unit, wherein the source may pass electromagnetic energy across the enclosed optical chamber through which the sensor unit gathers at least a sampling of emissions including any smoke from the flame of the flare sensing a change in at least one of transmittance and backscattering of electromagnetic energy due to presence of smoke in the optical chamber emanating from the flare, wherein the smoke is detectable by the smoke detecting electromagnetic energy sensor independent from combustion efficiency of the flare wherein the sensor unit detects the smoke inside the optical chamber and wherein the said electromagnetic energy sensor device creates a signal indicative of the smoke sensed in the optical chamber;

a change in at least one of transmittance and backscattering of electromagnetic energy due to presence of smoke by sensing particulate matter coming from the flame of the flare, wherein the smoke is detectable by the electromagnetic energy sensor independent from combustion efficiency of the flare wherein the sensor unit detects the smoke inside the optical chamber and wherein the said electromagnetic energy sensor device creates a signal indicative of the smoke sensed in the optical chamber;

a combustion efficiency electromagnetic energy sensor positioned to sense a change in at least one of absorbance and emission of electromagnetic energy due to constituents from the flare wherein electromagnetic energy absorption and emission by volatile organic compounds indicates the combustion efficiency of the flare independent from smoke in the flare wherein the said infrared energy absorption sensor creates a signal indicative of the volatile organic compounds sensed;

a smoke suppressant injector for injecting smoke suppressant into the flare; and a controller configured to adjust rate of smoke suppressant injection from the smoke suppressant injector to the flare based on signals received from either of the smoke detecting electromagnetic energy sensor and the combustion efficiency electromagnetic energy sensor, but receive signals from both.

5. The system according to claim 1, wherein the smoke suppressant injector is arranged to inject steam into the flare and wherein the controller is configured to increase and decrease the steam injection rate such that the steam injection rate is increased to limit smoke level and the steam injection rate is decreased to increase combustion efficiency based on thresholds for the signals respectively from the particulate matter sensor and the volatile organic compounds combustion efficiency sensor.

* * * * *